United States Patent [19]

Wepner et al.

[11] Patent Number: 4,644,836

[45] Date of Patent: Feb. 24, 1987

[54] PUNCH PRESS WITH VERTICALLY RECIPROCATING PLUNGER

[75] Inventors: Joachim Wepner, Gevelsberg; Kurt Wengenroth, Wuppertal, both of Fed. Rep. of Germany

[73] Assignee: Rolf Peddinghaus, Ennepetal, Fed. Rep. of Germany

[21] Appl. No.: 749,877

[22] Filed: Jun. 27, 1985

[30] Foreign Application Priority Data

Jun. 29, 1984 [DE] Fed. Rep. of Germany ..... 3423970

[51] Int. Cl.[4] ..... B21D 37/04; B30B 15/02

[52] U.S. Cl. ..... 83/698; 279/4

[58] Field of Search ..... 83/698, 449–552; 29/568; 279/4

[56] References Cited

U.S. PATENT DOCUMENTS 3,548,480 12/1970 Daniels ..... 83/563

3,762,264 10/1973 Scott ..... 83/698

*Primary Examiner*—James M. Meister

*Attorney, Agent, or Firm*—Karl F. Ross; Herbert Dubno

[57] ABSTRACT

A punch press has a vertically reciprocating plunger, and a die punch exchangeably secured at the plunger by means of a tool exchange device. The die punch has a die head, and the tool exchange device has an exchange insert with guide elements, and a retainer for the die head. The exchange insert is mountable in a holding annulus having guide elements which correspond complementary to the guide elements of the exchange insert. The die punch can be clamped by way of a clamping device against an abutment bearing. The abutment bearing is formed at the bottom side of a piston which is positively connected to the plunger. The piston forms part of the clamping device and has a shoulder surrounded at least over the extent thereof by the cylinder of a cylinder chamber of the clamping device and formed by a holding annulus. The holding annulus, in turn, is vertically adjustably connectable to the plunger by at least one reset spring and at least one guide rod. The piston engages with a centering spindle in the plunger and also centers the die head.

17 Claims, 4 Drawing Figures

PUNCH PRESS WITH VERTICALLY RECIPROCATING PLUNGER

FIELD OF THE INVENTION

Our present invention relates to punch presses and, more particularly, to punch or stamping presses with a vertically reciprocating plunger or ram.

BACKGROUND OF THE INVENTION

Punch and stamping presses are generally equipped with a die having a die head, and which can be releasably secured to the plunger by means of a tool exchange or replacement device.

The tool exchange device includes an exchange insert and guide elements for the exchange insert, as well as retainers for the die head. The exchange insert is mounted in a holding plate having guide elements which are formed complementarily with respect to the exchange insert guides. Furthermore, the die can be secured by means of a clamping device with respect to a counter-bearing or abutment.

It is known in such punch presses which are in use to equip the clamp device with a clamping which reaches beneath the die head of the die, and which presses this against the counter-bearing. Actuation of the tensioning slide is achieved by way of tightening or actuating screws. This entails operational difficulties and does not allow a rapid exchange of the tool. Furthermore, the prior art apparatus does not allow a simultaneous centering of the die head and, accordingly, of the die.

OBJECTS OF THE INVENTION

It is accordingly an object of our invention to provide a punch press in which the tool or die can be rapidly exchanged.

It is also an object of the invention to provide a punch press in which the die can be replaceably mounted and clamped rapidly and efficiently while simultaneously centering it.

SUMMARY OF THE INVENTION

These objects are attained in accordance with the invention in which the abutment or counter-bearing is brought about by the bottom end of a piston which is positively connected to the plunger. The piston is part of the clamping device and is formed with an annular shoulder while also being surrounded by the holding member or annulus which, for this purpose, is formed as the cylinder chamber of the clamping device, with the cylinder chamber substantially surrounding the annular shoulder of the piston. The holding member, in turn, is verticallly displaceable by means of at least one reset spring and at least one guide pin or guide rod. The piston, in turn, engages with a centering spindle or rod in the plunger, as well as being capable of centering the die head by way of centering elements.

In accordance with a preferred embodiment of the invention, the arrangement is made such that the holding member or annulus extends with inwardly directed flanges above the shoulder of the piston.

The teaching of the invention can be expressed in various ways and is of simple construction and allows easy assembly.

In accordance with one feature of the invention, there can be provided centering elements in the form of a low-tolerance or accurately fitting key and grooves or similar openings or recesses complementary to and cooperating with the key, whereby the recesses or grooves are arranged in the die head as well as in the surface which forms the abutment or counter-bearing.

The connection at the plunger can be direct or indirect. In the latter case, it is preferred that the plunger has a mounting plate at its bottom end and that by means of this the piston, the centering spindle, the reset spring, and the guide rod are connected to the plunger.

Sealing of the piston can be achieved in accordance with the teachings of the invention simply and with conventional sealing elements, for example O-rings.

The invention further teaches that the piston along its circumferential surface is provided with a groove for receiving and retaining an inserted seal ring. In the vicinity of the inwardly directed flange there can be provided a further similar seal ring. When provided in this manner, two sealing rings will generally be sufficient.

The attained advantages reside therein that in a punch press according to the present invention on the one hand in a simple and rapid manner the tool can be exchanged and this can also be done automatically.

Primarily use is made of a piston which is capable of a double function, firstly, centering and, secondly, clamping so that the attendant tolerances are reduced.

BRIEF DESCRIPTION OF THE DRAWING

The above and other objects, features and advantages will become more readily apparent from the following description, reference being made to the accompanying drawing, in which.

SPECIFIC DESCRIPTION

Figure 1:
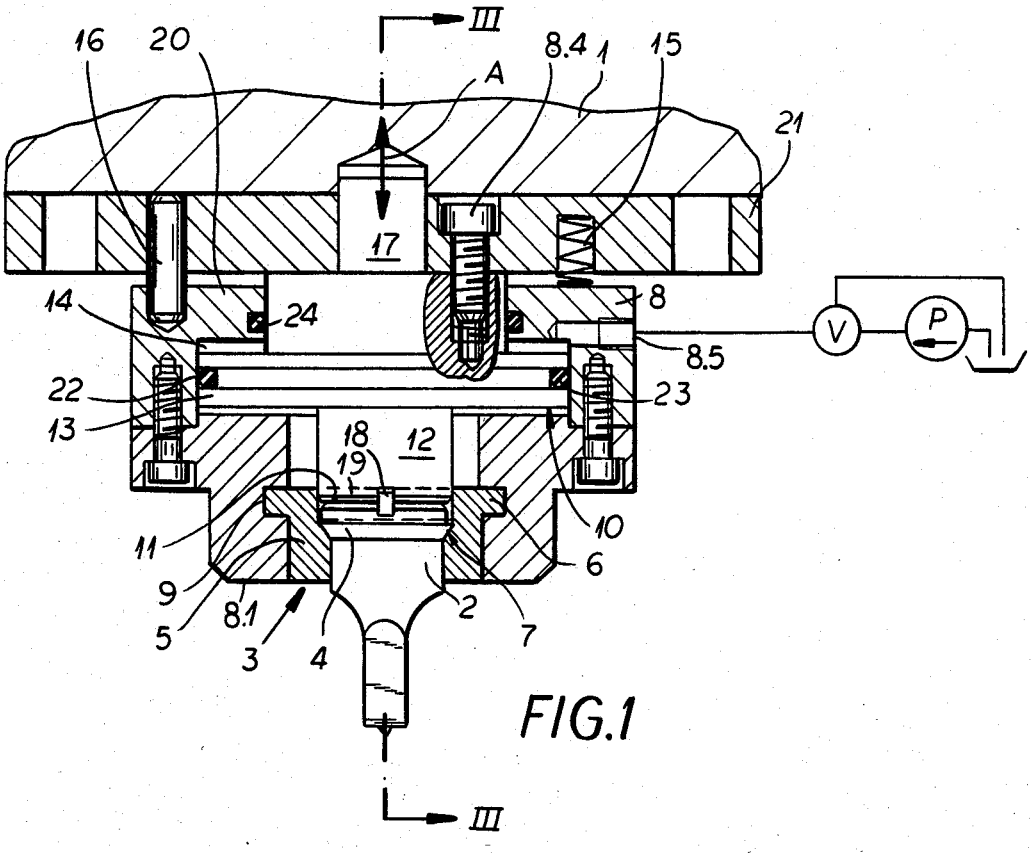
FIG. 1 is a vertical cross-sectional view through a punch press according to the invention in the region of the tool exchanger.

The punch press shown in part in the drawing figures has a plunger 1 which can be moved vertically up and down, i.e. it is mounted to be capable of carrying out vertically directed, reciprocating movements. These movements are indicated in FIG. 1 by the double-headed arrow A.

A tool, such as a die punch, male die, or similar die 2 is connected to the plunger 1. This connection is provided by a tool exchange device or tool exchanger 3. The die 2 has a die head 4. The tool exchanger 3 includes a sleeve forming an exchange insert 5 having exchange insert guide elements or formations such as a circular rib 6 and acts as a retainer for the die head 4. The exchange insert 5 is mounted in a holding member, for example a ring, plate, or annulus 8 which has guide elements 9 in the form of at least partly circular grooves which complement in size the guide elements 6 of the exchange insert 5. As shown, the exchanges has a frustoconical shoulder 7 for the frustoconical head 4, thereby enabling mutual centering of the two.

Figure 3:
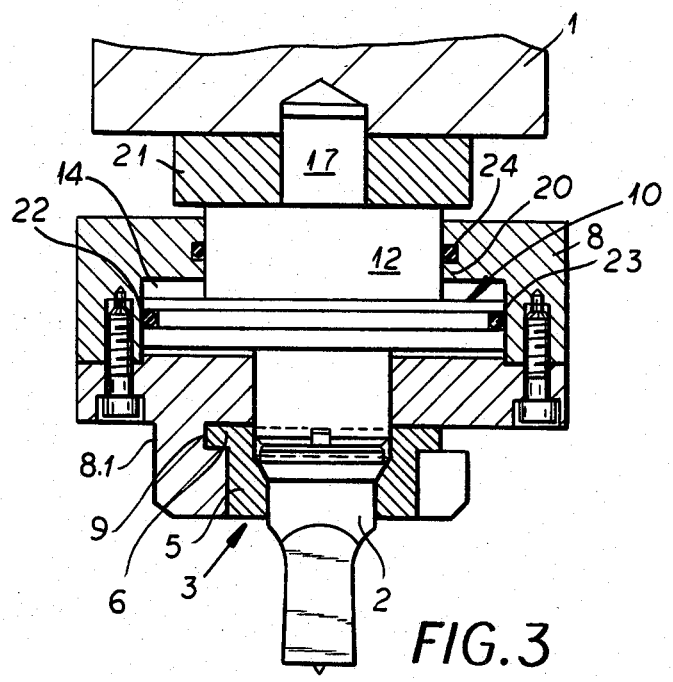
FIG. 3 is a cross-section of the clamping device in the operating position taken in the direction of arrows III—III in FIG. 1.

The die 2 can be clamped or fixed by means of a clamping device 10 with respect to a surface adapted to serve as an abutment, thrust or counter-bearing 11 when the clamping device 10 is in the operating position of the punch press. This operational position is indicated in FIGS. 1 and 3.

Figure 2:
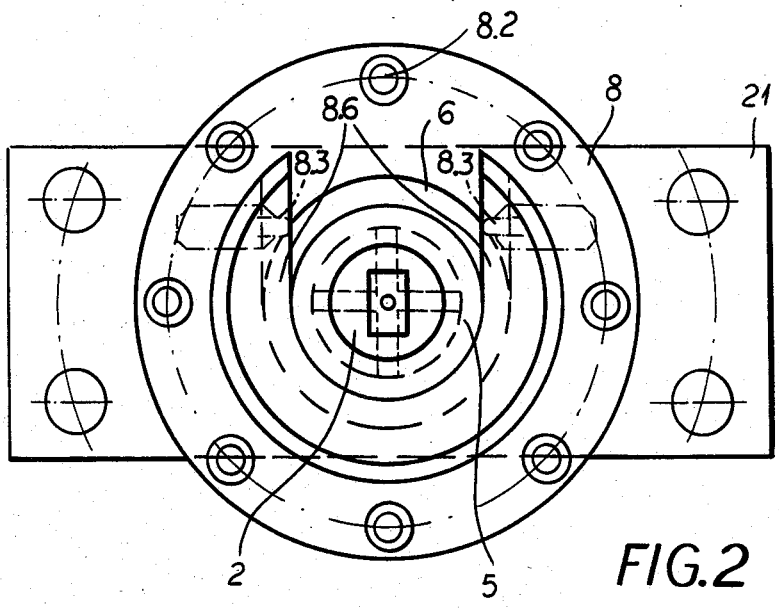
FIG. 2 is a bottom plan view of the embodiment according to FIG. 1.

The abutment 11 is formed at the bottom end of a piston 12 which is positively connected to the plunger 1, and the piston 12 forms part of or belongs to the clamping device 10. The piston 12 is formed with an annular shoulder 13 which is housed in the cylinder chamber 14, also forming part of the clamping device 10 and belonging to, or being at least in part formed by, the holding annulus 8. The part of the latter which is bifurcated as shown in FIG. 2 and reaches below the rib 6 to support the tool has been represented at 8.6.

The holding annulus 8, in turn, is vertically adjustable, i.e. up and down, by means of at least one restoring spring 15 and at least one guide rod or pin 16. This vertical adjustment is carried out to the extent of the clamping distance or play which is diagrammatically indicated by the distance S indicated in FIG. 4 and which can be understood by viewing FIGS. 3 and 4.

The piston 12, in turn, engages with its centering spindle or rod 17 in a corresponding recess in the plunger 1 and centers, on the other end, the die head 4, by way of centering elements 18 and 19.

The holding annulus 8 is formed at the upper end with an inwardly directed and circular flange 20 which extends behind the annular shoulder 13 of the piston 12. The centering elements are provided, on the one hand, by a separate adjustment key 18 and, on the other hand, by recesses or grooves 19 which are shaped in such a way that they can receive the key 18 with a small-tolerance fit. The grooves 19 are provided in the die head 4 as well as in the piston end surface which serves as the abutment or counter-bearing 11. The vertical height of the key should be less than the play S and the key 18 should extend in the direction of insertion and removal 25.

In the described embodiment and according to a preferred aspect of the invention, the described elements are not directly connected to the plunger 1, but are arranged at a mounting plate 21 which is arranged at the bottom end of the plunger 1. By way of this mounting plate 21, the elements including the piston 12, the centering spindle 17, the reset spring 15, and the guide rod 16 are connected to the plunger 1.

A groove 22 is provided in the piston 12, particularly in the circumference of its shoulder 13, and a sealing ring 23, in the form of an O-ring can be mounted in the groove 22. A further sealing ring 24 is provided in the region of the inwardly directed flange 20 of the holding annulus 8. When a hydraulic pressure medium is introduced into the cylinder chamber 14, there arises a functional position of annulus 8 which has been indicated in FIGS. 1 and 3, in which the die 2 is positively fixed or held.

Figure 4:
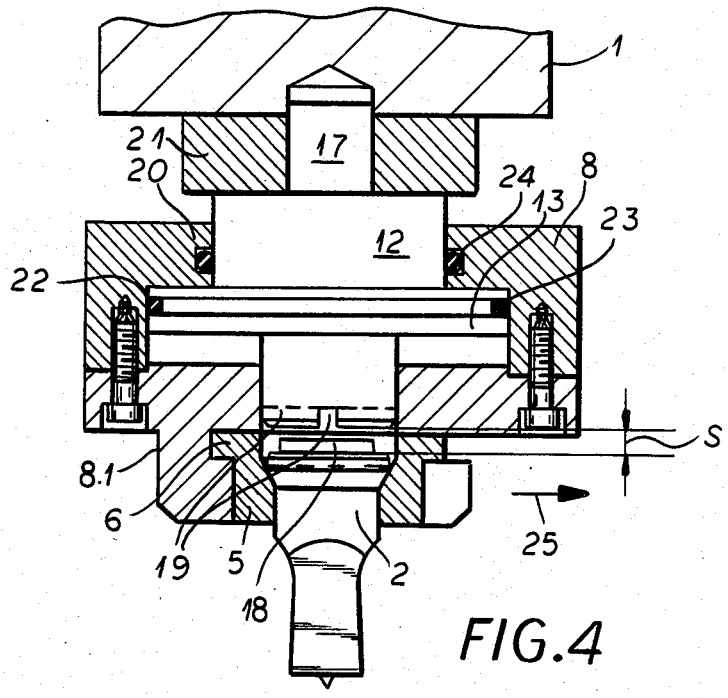
FIG. 4 is a view similar to FIG. 3 in another operational position, namely with the clamping device being shown in the position allowing exchange of the tool.

When the pressure of the hydraulic pressure medium is reduced towards zero pressure, the reset spring 15 can move the holding annulus 8 back downwardly, as is suggested in FIG. 4, and the die head 4 is set free. The clamping device is now released and the die 2 can be removed with the exchange insert 5 in the direction of the arrow 25 shown in FIG. 4, to the right, and therefore can be replaced by another die 2.

It is not necessary that the pressure of the hydraulic pressure medium in the cylinder chamber 14 be continuously maintained by the pump D acting on the shoulder 13, during operation of the punch press. Rather, upon closing of a valve V, the cylinder chamber 14 is disconnected from the pump P, whereby the action of the hydraulic pressure medium is maintained in the thus closed system. It will be obvious that the exchange of a tool or die in the described configuration of the punch press according to the invention can be carried out automatically without difficulties.

It is also obvious that the corresponding matrix or bottom die can have a matrix insert which also allows rapid and simple exchange or replacing in a similar or identical manner.

As indicated in the drawing and the foregoing, the holding member, or holding annulus 8, can be at least a two-component or three-component part, including an end cap 8.1 which is secured to the annulus part having the inwardly directed flange 20. Fastening, for example, is by eight fastening screws 8.2 evenly distributed about the circumference as can best be seen in FIG. 2.

A pair of lock members 8.3 are used to hold the guide element 6 in place. These lock members 8.3 are resilient to allow entry and are relatively rigid to preclude undesired egress of the guide element 6.

A screw 8.4 represents the means for securing the piston 12 on the plate 21.

The ports, e.g. such as port 8.5 in FIG. 1, passages, and connections for the circulating supply of hydraulic pressure medium to the cylinder chamber 14 are customary in the art and, accordingly, need not be shown or described in detail.

We claim:

1. In a punch press, the combination which comprises:

a reciprocating plunger;

a tool exchanger for selectively securing a die punch at said plunger, said tool exchanger including an exchange insert having guide elements and having a retainer for a die punch head;

a holding member resiliently and adjustably connected to said plunger by way of at least one reset spring and at least one guide rod, for operatively mounting said tool exchange insert, said holding member including guide elements which are complementary in shape to the guide elements of said exchange insert; and a clamping device between said die punch and said plunger for positively fixing said die punch to said plunger at least against a surface adapted to serve as an abutment bearing, said clamping device including a piston having at a free end thereof said surface adapted to serve as an abutment bearing, said piston being formed with a shoulder, said clamping device including a cylinder chamber housing said piston at least in the region of the shoulder thereof, and said cylinder chamber being at least in part formed by said holding member.

2. The combination defined in claim 1 wherein said piston is formed with a centering spindle at an end opposite said free end thereof having said surface adapted to serve as an abutment bearing, and wherein said plunger includes a recess to receive and guide said centering spindle.

3. The combination defined in claim 1 wherein said plunger is mounted for vertically reciprocating movements.

4. The combination defined in claim 1 wherein said holding member is a holding annulus which extends with a continuous inwardly directed annular flange overlying said piston shoulder.

5. The combination defined in claim 1 wherein said piston is adapted to be maintained under pressure by a pressure medium to hold under force said die punch head in said retainer when said die punch engages said surface adapted to serve as an abutment bearing.

6. The combination defined in claim 1, further comprising means for centering said piston and said die punch.

7. The combination defined in claim 6 wherein said means for centering include at least one recess formed in said free end thereof having said surface adapted to serve as an abutment bearing, and at least one recess formed in an opposing end surface of the die punch, and further including at least one key element adapted to be seated in said recesses.

8. The combination defined in claim 2, further including a mounting plate secured at an underside of said plunger, said mounting plate serving to connect said plunger to components of said holding member including said piston, said centering spindle, said at least one reset spring, and said at least one guide rod.

9. The combination defined in claim 4 wherein said piston is formed at a circumference of said shoulder with at least one first groove and further including a first seal ring seated therein.

10. The combination defined in claim 9 wherein said annular flange is formed at an inwardly directed circumferential face with at least one second groove and further including a second seal ring seated therein.

11. A tool-replacement device for a punch press, comprising:

a piston;

means for mounting said piston on a press part;

a holding element surrounding said piston and axially displaceable relative to said piston on said press part, said holding element defining a cylinder pressurizable to draw an end of said element toward said part, said element having a holder at said end for engagement with a tool and centering same with respect to said press part;

guide means on said press part and said holding element for guiding said element during movement thereof relative to said piston; and a spring bearing on said element and said press part for biasing said element away from said part.

12. The device defined in claim 11 wherein said piston has an annular shoulder, said element having a pair of interconnected portions axially straddling said shoulder.

13. The device defined in claim 12, further comprising a plate mounting said piston on said press part.

14. The device defined in claim 13 wherein said piston has a cylindrical portion between said plate and said shoulder, further comprising a sealing ring on said shoulder engaging said element and another sealing ring on said element engaging said portion of said piston.

15. The device defined in claim 14 wherein said piston has a centering pin projecting axially through said plate and into said press part.

16. The device defined in claim 15 wherein said holder is a radially open formation receiving a sleeve carrying said tool, said sleeve and said holder having mating centering rib and groove formations.

17. The device defined in claim 16 wherein said piston and said tool have confronting surfaces formed with recesses each opening in the direction of the other surface and registering with the recess thereof, a key being received in said recesses.

* * * * *